US008508454B2

(12) United States Patent
Chang et al.

(10) Patent No.: US 8,508,454 B2
(45) Date of Patent: Aug. 13, 2013

(54) LIQUID CRYSTAL DISPLAY DEVICE AND METHOD FOR DRIVING THE SAME

(75) Inventors: Kuk Hui Chang, Paju-si (KR); Young Nam Lee, Paju-si (KR); Hyoung Sik Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 492 days.

(21) Appl. No.: 12/836,330

(22) Filed: Jul. 14, 2010

(65) Prior Publication Data

US 2011/0128215 A1 Jun. 2, 2011

(30) Foreign Application Priority Data

Nov. 27, 2009 (KR) ..... 10-2009-0116179

(51) Int. Cl.
*G09G 3/36* (2006.01)

(52) U.S. Cl.
USPC ..... 345/98; 345/204; 345/211; 345/212; 345/213; 345/99; 345/100

(58) Field of Classification Search
USPC ..... 345/98, 204, 211–213, 99–100
See application file for complete search history.

(56) References Cited

U.S. PATENT DOCUMENTS

| | | | | |
|---|---|---|---|---|
| 6,031,757 | A * | 2/2000 | Chuang et al. | 365/185.04 |
| 2006/0022707 | A1 * | 2/2006 | Simons | 326/59 |
| 2006/0125754 | A1 * | 6/2006 | Rao et al. | 345/93 |
| 2010/0201698 | A1 * | 8/2010 | Lee | 345/536 |

* cited by examiner

*Primary Examiner* — Lun-Yi Lao
*Assistant Examiner* — Saiful A Siddiqui
(74) *Attorney, Agent, or Firm* — McKenna Long & Aldridge, LLP

(57) ABSTRACT

An LCD device adapted to cut costs through the simplification of circuitry is disclosed. The LCD device includes a timing controller that includes: an inter-integrated circuit driver and a memory which are configured to communicate with an external system using an inter-integrated circuit protocol; and a logic element configured to operate a first logic signal from a first write protection terminal of the external system with a second logic signal from a second write protection terminal of the inter-integrated circuit driver, and to apply the operated logic signal to the memory. The memory replies to the operated logic signal from an output terminal of the logic element and performs a write operation.

10 Claims, 3 Drawing Sheets

LIQUID CRYSTAL DISPLAY DEVICE AND METHOD FOR DRIVING THE SAME

CROSS-REFERENCE TO RELATED APPLICATION

This application claims priority under 35 U.S.C. 119 to Korean Patent Application No. 10-2009-0116179, filed on Nov. 27, 2009, which is hereby incorporated by reference in its entirety for all purposes.

BACKGROUND

1. Field of the Disclosure

This disclosure relates to a liquid crystal display (LCD) device adapted to cut costs through the simplification of circuitry, and a driving method thereof.

2. Description of the Related Art

Recently, a variety of flat panel display devices with reduced weight and volume have been widely used instead of cathode ray tube (CRTs). The flat panel display devices include liquid crystal display (LCD) devices, field emission display (FED) devices, plasma display panels (PDPs), and organic electro luminescence display (OLED) devices.

Among these flat display devices, LCD devices selectively transmit light from a rear-positioned light source using pixels of a front-positioned LCD panel as a light switch and display images. In other words, LCD devices control the intensity of light generated in a light source, unlike CRTs which control brightness by adjusting the intensity of an electron beam, in order to display images.

Such LCD devices each include an LCD panel, a timing controller, and gate and data drivers for driving the LCD panel using timing signals applied from the timing controller.

The LCD panel includes a plurality of gate lines for transferring scan signals and a plurality of data lines for transferring image data signals. The plurality of data lines crosses the plurality of gate lines. The LCD panel further includes pixels defined by the gate and data lines, The gate driver includes at least one gate driver integrated-circuit chip which is configured to drive the plurality of gate lines. Similarly, the data driver includes at least one data driver integrated-circuit chip which is configured to drive the plurality of data lines.

The timing controller included in the LCD device is configured to control the gate driver and the data driver. The timing controller is mounted on a driver printed-circuit-board (PCB), which is disposed under the LCD panel, together with an electrically erasable programmable read only memory (EEPROM) and a variety of circuits. The EEPROM reads information regarding definition and timing from a system and applies the read information to the timing controller, when the system is booted.

However, the circuitry of the driver PCB can be very complex due to the fact that a variety of circuits together with the timing controller and EEPROM are mounted on the driver PCB under the LCD panel. As such, the related art LCD device increases its manufacturing costs. Moreover, the area of the driver PCB can not be effectively used.

BRIEF SUMMARY

Accordingly, the present embodiments are directed to an LCD device that substantially obviates one or more of problems due to the limitations and disadvantages of the related art, and a driving method thereof.

An object of the present embodiment is to provide an LCD device that is adapted to cut costs through the simplification of circuitry, and a driving method thereof.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to one general aspect of the present embodiment, an LCD device includes a timing controller. The timing controller includes: an inter-integrated circuit driver and a memory which are configured to communicate with an external system using an inter-integrated circuit protocol; and a logic element configured to operate a first logic signal from a first write protection terminal of the external system with a second logic signal from a second write protection terminal of the inter-integrated circuit driver, and to apply the operated logic signal to the memory. The memory replies to the operated logic signal from an output terminal of the logic element and performs a write operation.

A driving method of an LCD device according to another general aspect of the present embodiment relates an LCD device with a timing controller including an inter-integrated circuit driver and a memory which are configured to communicate with an external system according to an inter-integrated circuit protocol. The method includes; inputting a first logic signal from a write protection terminal of the external system to a first terminal of a logic element; applying a second logic signal from a write protection terminal of the inter-integrated circuit driver to a second terminal of the logic element; and forcing the memory to perform a write operation by a control signal output from an output terminal of the logic element.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION

Figure 1:
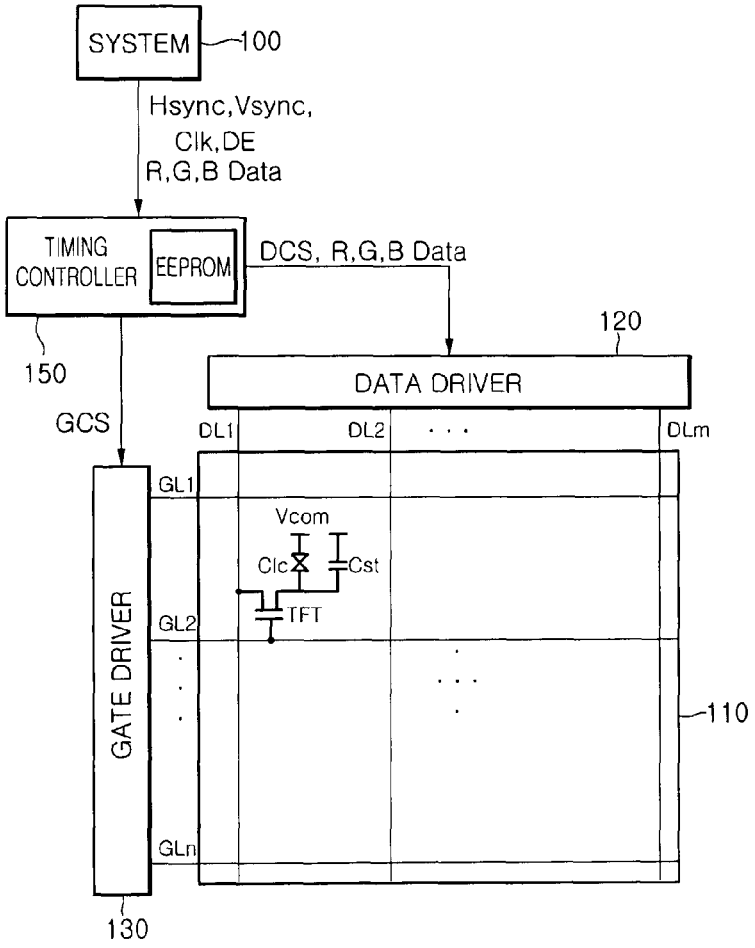
FIG. 1 is a block diagram schematically showing an LCD device according to an embodiment of the present disclosure.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

In the present disclosure, an LCD device among flat panel display devices will now be described as an embodiment.

Figure 2:
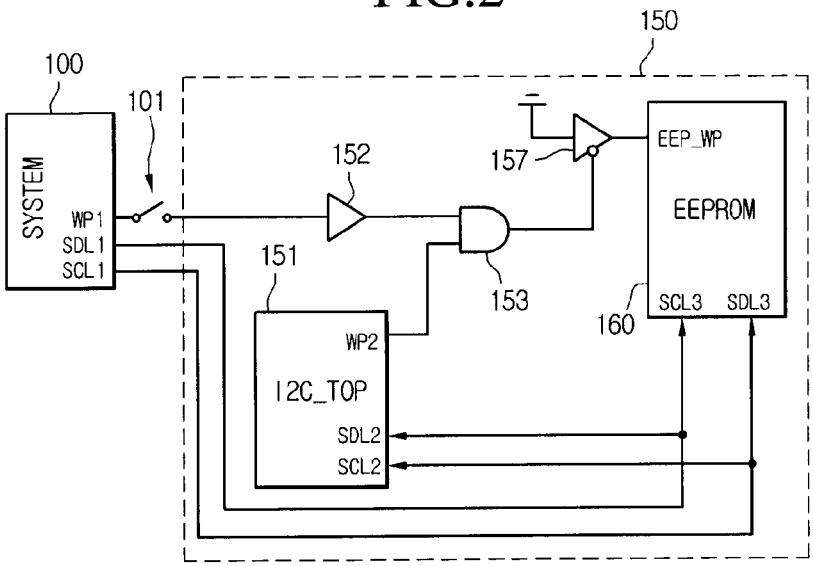
FIG. 2 is a detailed circuit diagram showing the configuration for a part of the LCD device according to an embodiment of the present disclosure.

FIG. 1 is a block diagram schematically showing an LCD device according to an embodiment of the present disclosure. FIG. 2 is a detailed circuit diagram showing the configuration for a part of the LCD device according to an embodiment of the present disclosure.

Referring to FIGS. 1 and 2, an LCD device according to an embodiment of the present disclosure includes: an LCD panel 110 configured to include gate lines GL1~GLn, data lines DL1~DLm, and thin film transistors TFT; a data driver 120 configured to apply data signals to the data lines DL1~DLm of the LCD panel 110; a gate driver 130 configured to apply scan signals to the gate lines of the LCD panel 110; and a timing controller 150 configured to control the data and gate drivers 120 and 130. The gate lines GL1~GLn and the data lines DL1~DLM are formed to cross each other on the LCD panel 110. The thin film transistors TFT are formed at intersections of the gate lines GL1~GLn and data lines DL1~DLm, in order to drive respective liquid crystal cells Clc.

Although it is not shown in drawings, the LCD device further includes a direct current-direct current (DC-DC) converter and a gamma voltage generator. The DC-DC converter is configured to generate a variety of voltages necessary to drive the LCD panel 110. The gamma voltage generator is configured to generate a set of gamma reference voltages to be applied to the data driver 120.

The thin film transistors TFT are used as a switching element for the respective liquid crystal cell on the LCD panel 110. To this end, each of the thin film transistors TFT is configured to include a gate electrode connected to the respective gate line GL, a source electrode connected to the respective data line DL, and a drain electrode connected to a pixel electrode of the respective liquid crystal cell Clc and one electrode of respective storage capacitor Cst. The liquid crystal cells Clc is formed to have a common electrode which receives a common voltage Vcom. Each of the storage capacitors Cst is used to maintain a voltage charged in the respective liquid crystal cell Clc. To this end, the storage capacitors Cst charge data voltages of the data signal from the respective data lines DL1~DLm, when the respective thin film transistors TFT are turned-on.

The thin film transistors TFT are sequentially turned-on line by line as the scan pulses are sequentially applied to the gate lines GL1~GLn. The turned-on thin film transistors TFT form channels between their source electrodes and drain electrodes, so that the data signals on the data lines DL1~DLm are applied to the pixel electrodes of the respective liquid crystal cells Clc. As such, liquid crystal molecular alignment of the respective liquid crystal cell Clc is changed by an electric field between the respective pixel electrode and the common electrode, so as to modify incident light.

The data driver 120 replies to data drive control signals DCS applied from the timing controller 150 and supplies the data signals to the data lines DL1~DLm. To this end, the data driver 120 samples and latches image data "R, G, and B Data" input from the timing controller 150. The data driver 120 converts the latched image data "R, G, and B Data" into the data signals of an analog voltage shape using the set of gamma reference voltages from the gamma voltage generator. The data signals of an analog voltage shape allow the liquid crystal cell Clc to display the gray-scales. Such data signals are applied to the data lines DL1~DLm on the liquid crystal panel 110. On the other hand, the data drive control signals DCS applied from the timing controller 150 can include a source start pulse SSP, a source shift clock SSC, a source output enable signal SOE, a polarity inversion signal POL, and so on.

The gate driver 130 sequentially generates the scan pulses using gate drive control signals GCS applied from the timing controller 150. The scan pulses are sequentially applied to the respective gate lines GL1~GLn. The gate drive control signals GCS generated in the timing controller 150 can include a gate start pulse GSP, at least one gate shift clock GSC, a gate output enable signal GOE, and so on.

The timing controller 150 uses horizontal and vertical synchronous signals Hsync and Vsync, a data enable signal DE, and a clock signal Clk, which are applied from a system 100, in order to control the data driver 120 and the gate driver 130 and apply the image data "R, G, and B Data". To this end, the timing controller 150 refers to information about definition and controlling protocols. The system 100 is positioned outside of the LCD device.

Such a timing controller 150 is configured to include an EEPROM 160 and an inter-integrated circuit driver (hereinafter, I2C-TOP) 151, in order to simplify the circuitry of the LCD device (more specifically, a driver PCB). The EEPROM 160 is used to store the above information including definition and controlling protocols. The I2C-TOP 151 controls the EEPROM 160 to write control data including the above information, according to an I2C protocol.

The system 100 communicates with the I2C-TOP 151 and the EEPROM 160, which are connected to all its first serial clock and data terminals SCL1 and SDL1, according to an I2C protocol. As such, the I2C-TOP 151 is configured to include second serial clock and data terminals SCL2 and SDL2, and the EEPROM 160 is configured to include third serial clock and data terminals SCL3 and SDL3.

In other words, the first through third serial clock terminals SCL1 through SCL3 and the first through third serial data terminals SDL1 through SDL3 are used for the communication between the system 100, the I2C-TOP 151, and the EEPROM 160 according to the I2C protocol. To this end, the first through third serial clock terminals (i.e., the serial clock terminals of the system 100, I2C-TOP 151, and EEPROM 160) SCL1 through SCL3 are connected to one another by means of an I2C clock line. Similarly, the first through third serial data terminals (i.e., the serial data terminals of the system 100, I2C-TOP 151, and EEPROM 160) SDL1 through SDL3 are connected to one another by means of an I2C data line. The I2C clock line configures an I2C bus together with the I2C data line. Also, the I2C clock and data lines can be connected to a high voltage line (not shown) through respective pull-up resistors (not shown), in order to improve stability of the communication between the system 100, the I2C-TOP 151, and the EEPROM 160.

The system 100 is further configured to include a first write protection terminal WP1. Similarly, the I2C-TOP 151 is configured to include a second write protection terminal WP2. The EEPROM 160 is also configured to include a memory write protection terminal EEP_WP for receiving control signals from the first and second write protection terminals WP1 and WP2. The control signal to be applied to the memory write protection terminal EEP_WP controls a write operation timing of the EEPROM 160.

The LCD device of the present embodiment still further includes a switch 101 serially connected to the first write protection terminal WP1 of the system 101. The timing controller 150 according to an embodiment of the present disclosure is further configured to include a first buffer 151 serially connected to the switch 101, and a logic element 153 with a first input terminal connected to an output terminal of the first buffer 152.

The logic element 153 is configured to include a second input terminal connected to the second write protection terminal WP2 of the I2C-TOP 151. An AND gate is used as an example of the logic element 153, but it is not limited to this. In other words, the logic element 153 can be configured to include at least one of OR, NOR, NAND, EOX, and NEOX gates, if necessary. Such a logic element 153 logically operates the control signals on its first and second input terminals, and outputs the operated control signal.

The timing controller 150 according to an embodiment of the present disclosure is still further configured to include a second buffer 157 which has an inverse control terminal connected to the output terminal of the logic element 153 and an output terminal connected to the memory write protection terminal EEP_WP of the EEPROM 160. The second buffer 157 has an input terminal connected to a low voltage line GND. Although it is not shown in the drawings, the output terminal of the second buffer 157 may be connected to the high voltage line (not shown) via a pull-up resistor (not shown). Therefore, the EEPROM 160 selectively performs a write operation according to the logically operated control signal which is applied from the output terminal of the logic element 153 via the second buffer 157.

When initial data including the above information is written in such an LCD device of the present embodiment, the switch 101 serially connected to the first write protection terminal WP1 is turned-on, so that the control signal of a low logic level is applied from the first write protection terminal WP1 to the first input terminal of the logic element 153 via the switch 101 and the first buffer 152. Then, the logic element 153 outputs the logically operated control signal with a low logic level regardless of the control signal on the second write protection terminal WP2 of the I2C-TOP 151, because it is configured to include the AND gate. The logically operated control signal output from the logic element 153 is applied to the memory write protection terminal EEP_WP of the EEPROM 160 via the second buffer 157, thereby enabling the EEPROM 160 to perform a write operation for the initial data.

After the initial data is written in the LCD device of the present embodiment, the switch 101 is turned-off. Then, a previously established high logic signal is input to the first input terminal of the logic element 153 through the first buffer 152. The high logic signal is generated because the input terminal of the first buffer 152 is connected to the high voltage line (not shown) via a pull-up resistor (not shown). At the same time, the I2C-TOP 151 applies the control signal of a high logic level to the second input terminal of the logic element 153 through the second write protection terminal WP2. Therefore, the data written in the EEPROM 160 does not change because the logically operated control signal with the high logic level is applied to the memory write protection terminal EEP_WP of the EEPROM 160.

In this manner, the LCD device according to an embodiment of the present disclosure allows the EEPROM 160 and the logic element 153 configured to receive a control signal, which has a low logic level or a high logic level according to the turning-on/off state of the switch 101 connected the first write protection terminal WP1 of the system 100, to be included in the timing controller 150. As such, the EEPROM 160 can perform the write operation. Therefore, the LCD device can be simplified circuitally. As a result, the LCD device can reduce manufacturing costs, and improve the space efficiency of the driver PCB.

Figure 3:
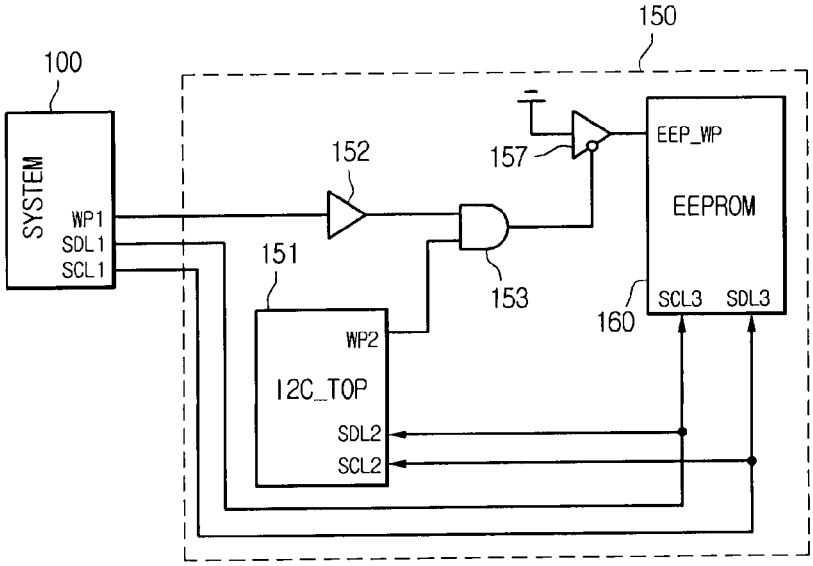
FIG. 3 is a detailed circuit diagram showing the configuration for a part of an LCD device according to another embodiment of the present disclosure.

FIG. 3 is a detailed circuit diagram showing the configuration for a part of an LCD device according to another embodiment of the present disclosure.

The LCD device of another embodiment in FIG. 3 has the same configuration as that according to an embodiment of the present disclosure shown in FIGS. 1 and 2, with the exception of removing the switch 101. As such, the rest of the LCD device according to another embodiment without removing the switch 101 will be referred to using the same numbers as those according to that embodiment. Moreover, the detailed description for the rest of the LCD device of another embodiment without removing the switch 101 will be omitted.

The switch 101 of FIG. 2, which is connected between the first write protection terminal WP1 of the system 100 and the first buffer 152, is removed from the LCD device of another embodiment, as shown in FIG. 3. As such, the control signal output from the first write protection terminal WP1 is always set to a high logic level after the initial data is written in the EEPROM 160.

If an update of the data written in the EEPROM 160 is required, the control signal output from the second write protection terminal WP2 transits from the high logic level into a low logic level. The control signal with the low logic level on the second write protection terminal WP2 is applied to the memory write protection terminal EEP_WP of the EEPROM 160 via the logic element 153 and the second buffer 157. Then, the EEPROM 160 performs the write operation of an updated data.

When the EEPROM 160 completes the write operation of updated data, the I2C-TOP 151 forces the control signal on the second write protection terminal WP2 to be changed from the low logic level into the high logic level. Therefore, the LCD device is driven on the basis of the updated data within the EEPROM 160.

The data update requirement can be identified from communications which are performed between the second serial clock and data terminals SCL2 and SDL2 of the I2C-TOP 151 and the third serial clock and data terminals SCL3 and SDL3 of the EEPROM 160.

Figure 4:
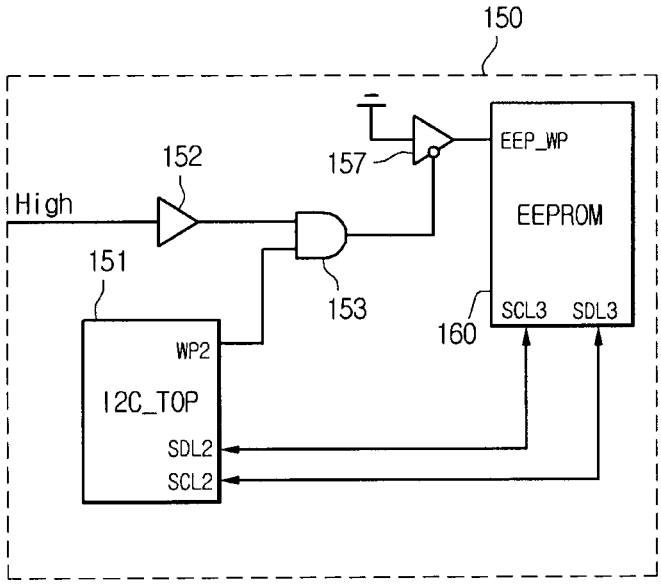
FIG. 4 is a detailed circuit diagram showing the configuration of a timing controller when the LCD device according to an embodiment of the present disclosure is normally driven.

FIG. 4 is a detailed circuit diagram showing the configuration of the timing controller when the LCD device according to an embodiment of the present disclosure is normally driven.

As shown in FIG. 4, the timing controller 150 allows a high logic signal to be applied to the first input terminal of the logic element 153 via the first buffer 152, when the LCD device of the present embodiment is normally driven. The I2C-TOP 151 also applies a control signal of the high logic level to the second input terminal of the logic element 153. Then, the logic element 153 outputs a logically operated control signal with the high logic level. The EEPROM 160 does not perform the write operation due to the logically operated control signal of the high logic level. Therefore, the timing controller 150 uses the data which is written in the EEPROM 160, and controls the data and gate drivers 120 and 130. In other words, the LCD device is driven on the basis of the data written in the EEPROM 160.

As described above, the LCD devices according to embodiments of the present disclosure allow the EEPROM 160 to be included within the timing controller 150. As such, the LCD devices can be simplified circuitally. Therefore, the LCD devices can reduce manufacturing costs, and improve the space efficiency of the driver PCB.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

What is claimed is:

1. A liquid crystal display device with a timing controller including:

an inter-integrated circuit driver and a memory which are configured to communicate with an external system using an inter-integrated circuit protocol; and a logic element configured to operate a first logic signal from a first write protection terminal of the external system with a second logic signal from a second write protection terminal of the inter-integrated circuit driver, and to apply the operated logic signal to the memory, wherein the memory to replies the operated logic signal from an output terminal of the logic element and performs a write operation, and wherein the external system communicates with the inter-integrated circuit driver and the memory directly, wherein the timing controller further includes:

a first buffer directly connected between an input terminal of the logic element and the first write protection terminal of the external system; and a second buffer directly connected between the output terminal of the logic element and a memory write protection terminal of the memory.

2. The liquid crystal display device claimed as claim 1, further comprising a switch connected between the first buffer and the first write protection terminal of the external system.

3. The liquid crystal display device claimed as claim 1, wherein the logic element is configured to include an AND gate.

4. The liquid crystal display device claimed as claim 1, wherein the memory is configured to include an electrically erasable programmable read only memory.

5. A method of a liquid crystal display device with a timing controller including an inter-integrated circuit driver and a memory which are configured to communicate with an external system according to an inter-integrated circuit protocol, the method comprising;

inputting a first logic signal from a first write protection terminal of the external system to a first terminal of a logic element;

applying a second logic signal from a second write protection terminal of the inter-integrated circuit driver to a second terminal of the logic element; and forcing the memory to perform a write operation by a control signal output from an output terminal of the logic element, and wherein the external system communicates with the inter-integrated circuit driver and the memory directly, wherein the timing controller further includes:

a first buffer directly connected between an input terminal of the logic element and the first write protection terminal of the external system; and a second buffer directly connected between the output terminal of the logic element and a memory write protection terminal of the memory.

6. The method claimed as claim 5, wherein the logic element is configured to include an AND gate.

7. The method claimed as claim 5, wherein the liquid crystal display device further includes a switch connected between the logic element and the first write protection terminal of the external system.

8. The method claimed as claim 7, wherein the first logic signal applied from the first write protection terminal of the external system to the logic element has a low logic level when the switch is turned-on.

9. The method claimed as claim 5, wherein the first logic signal output from the first write protection terminal of the external system is set to a high logic level.

10. The method claimed as claim 9, further comprises transiting the second logic signal on the second write protection terminal of the inter-integrated circuit driver from a high logic level into a low logic level when an update of the data written in the memory is required.

* * * * *